US009472133B2

(12) United States Patent
Kim et al.

(10) Patent No.: US 9,472,133 B2
(45) Date of Patent: Oct. 18, 2016

(54) DEVICES AND METHOD OF ADJUSTING SYNCHRONIZATION SIGNAL PREVENTING TEARING AND FLICKER

(75) Inventors: Kyoung Man Kim, Suwon-si (KR); Jong Ho Roh, Yongin-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 814 days.

(21) Appl. No.: 13/613,942

(22) Filed: Sep. 13, 2012

(65) Prior Publication Data

US 2013/0155036 A1 Jun. 20, 2013

(30) Foreign Application Priority Data

Dec. 20, 2011 (KR) ..... 10-2011-0137953

(51) Int. Cl.
*G09G 5/10* (2006.01)
*G09G 3/20* (2006.01)

(52) U.S. Cl.
CPC ..... *G09G 3/2092* (2013.01); *G09G 2310/08* (2013.01); *G09G 2320/0247* (2013.01); *G09G 2330/021* (2013.01); *G09G 2370/08* (2013.01)

(58) Field of Classification Search
CPC ..... G09G 3/2092; G09G 2370/08; G09G 2330/021; G09G 2320/0247; G09G 2310/08
See application file for complete search history.

(56) References Cited

U.S. PATENT DOCUMENTS

2007/0176883 A1* 8/2007 Hsu ..... G09G 3/342 345/102
2008/0170087 A1* 7/2008 Kim ..... G09G 3/3611 345/690
2008/0174540 A1 7/2008 Lee
2009/0225095 A1* 9/2009 Kojima ..... G09G 3/3611 345/545
2011/0310268 A1* 12/2011 Shiohara ..... H04N 5/23293 348/222.1
2012/0086740 A1* 4/2012 Murai ..... G09G 3/3406 345/690

FOREIGN PATENT DOCUMENTS

| | | | |
|---|---|---|---|
| CN | 1476233 | | 2/2004 |
| CN | 101046941 | | 10/2007 |
| CN | 101325721 | | 12/2008 |
| CN | 101873131 | | 10/2010 |
| JP | 2005-010194 | | 1/2005 |
| JP | WO/2011/001719 | * | 1/2011 |
| WO | 2011001719 | | 1/2011 |

OTHER PUBLICATIONS

Office Action of the Chinese Patent Application No. 201210548250.X, issued Mar. 29, 2016 from S.I.P.O (in Chinese).
R.O.C. Patent Application No. 101137201, Office Action dated Apr. 26, 2016.

* cited by examiner

*Primary Examiner* — Adam R Giesy
(74) *Attorney, Agent, or Firm* — F. Chau & Associates, LLC

(57) ABSTRACT

A display controller includes a synchronization signal adjusting circuit, which adjusts at least one of the delay and the pulse width of a synchronization signal generated in a display driver and outputs an adjusted synchronization signal, and a transmission timing control circuit configured to control the transmission timing of display data, which will be transmitted to the display driver, in response to the adjusted synchronization signal.

23 Claims, 12 Drawing Sheets

DEVICES AND METHOD OF ADJUSTING SYNCHRONIZATION SIGNAL PREVENTING TEARING AND FLICKER

CROSS-REFERENCE TO RELATED APPLICATIONS

This application claims priority under 35 U.S.C. §119(a) to Korean Patent Application No. 10-2011-0137953 filed on Dec. 20, 2011,which is incorporated by reference in its entirety herein.

BACKGROUND

1. Technical Field

Embodiments of the present inventive concept relate to a semiconductor device, and more particularly, to devices which may adjust at least one of the delay and the pulse width of a synchronization signal to prevent tearing and flicker and a method thereof.

2. Discussion of the Related Art

As display resolution of a portable device such as a smart phone or a tablet personal computer (PC) increases, the bandwidth requirement of memory accesses also increases. As the resolution increases, power consumption of the portable device also tends to increase.

Accordingly, a method for reducing power consumption of the portable device is desirable. And, as display resolution of the portable device increases, there can be a flicker on a screen of images displayed in the display.

SUMMARY

An aspect of the present invention is directed to provide a display controller, including an adjusting circuit configured to adjust (based on received information for adjusting the synchronization signal) at least one of the delay and the pulse width of a synchronization signal generated in a display driver and output an adjusted synchronization signal, and a transmission timing control circuit configured to control the transmitting timing of display data to be transmitted to the display driver in response to the adjusted synchronization signal.

The synchronization signal may be a signal related to transmission of the display data. The adjusting circuit includes an information register configured to store the information for adjusting the synchronization signal and an adjusting logic circuit configured to adjust at least one of the delay and the pulse width of the synchronization signal.

The transmission timing control circuit transmits the display data to the display driver in response to one of a rising edge and a falling edge of the adjusted synchronization signal.

The display controller further includes a transmission interface configured to prepare transmission of the display data in response to one of a rising edge and a falling edge of the adjusted synchronization signal and transmit the display data to the display driver in response to the other of the rising edge and the falling edge.

The transmission interface may be a CPU interface, a RGB interface or a serial interface. The transmission interface may be a Mobile Display Digital Interface (MDDI), a Mobile Industry Processor Interface (MIPI®), a serial peripheral interface (SPI), an inter IC ($I^2C$) interface, a display port (DP) or an embedded display port (eDP).

The display controller further includes a timing controller configured to generate a first control signal in response to one of a rising edge and a falling edge of the adjusted synchronization signal and generate a second control signal in response to the other of the rising edge and the falling edge, and a transmission interface configured to prepare transmission of the display data in response to the first control signal and transmit the display data to the display driver in response to the second control signal.

The transmission timing control circuit generates difference information corresponding to difference between a level transit timing of the adjusted synchronization signal and the controlled transition timing, and the adjusting circuit adjusts the synchronization signal by using the difference information as the information for adjusting the synchronization signal.

The adjusting circuit includes a register configured to store the difference information, a delay adjusting circuit configured to adjust the delay of the synchronization signal by using the difference information as the information for adjusting the synchronization signal and a pulse width adjusting circuit configured to adjust the pulse width of the delay-adjusted synchronization signal output from the delay adjusting circuit by using the difference information as the information for adjusting the synchronization signal and to generate the adjusted synchronization signal.

An aspect of the present inventive concepts is directed to provide an image data processing system, including a display controller, which includes an adjusting circuit adjusting (based on received information for adjusting the synchronization signal) at least one of the delay and the pulse width of a synchronization signal generated in a display driver and outputting an adjusted synchronization signal and a transmission timing control circuit controlling the transmission timing of display data to be transmitted to the display driver in response to the adjusted synchronization signal.

According to an exemplary embodiment, the adjusting circuit may be embodied inside of the display driver. According to an alternative exemplary embodiment, the adjusting circuit may be embodied inside of the display controller.

The adjusting circuit includes a register and an adjusting logic circuit adjusting at least one of the delay and the pulse width by using the information (i.e., the information for adjusting the synchronization signal) stored in the register.

An aspect of the present inventive concepts is directed to provide a display data processing method of a portable device, including receiving a synchronization signal which is output from a display driver and is related to transmission of display data, adjusting at least one of the delay and the pulse width of the synchronization signal and generating an adjusted synchronization signal, adjusting (based on received information for adjusting the synchronization signal) the transmission timing of the display data in response to the adjusted synchronization signal and transmitting transmission timing-controlled display data to the display driver, and processing the display data and displaying processed display data on a display.

The generating the adjusted synchronization signal adjust at least one of the delay and the pulse width by using information output from a display controller adjusting the transmission timing and generates the adjusted synchronization signal.

The information for adjusting the synchronization signal may be information determined according to difference between a level transition timing of the adjusted synchronization signal and the adjusted transmission timing.

The portable device may be one of a cellular phone, a smart phone and a tablet PC.

Another aspect of the present inventive concepts is directed to provide the display data processing method of the portable device, including detecting a mode change command in a CPU, transmitting a control signal corresponding to a detection result to a display driver, receiving a synchronization signal which is output from the display driver and related to transmission of display data, adjusting (based on received information for adjusting the synchronization signal) at least one of the delay and the pulse width of the synchronization signal and generating an adjusted synchronization signal, adjusting the transmission timing of the display data in response to the adjusted synchronization signal and transmitting transmission timing-adjusted display data to the display driver, and processing the display data and displaying processed display data on a display. The synchronization signal is generated based on the control signal. The generating the adjusted synchronization signal adjusts at least one of the delay and the pulse width by using information output from a display controller adjusting the transmission timing and generates the adjusted synchronization signal.

Exemplary embodiments of the inventive concept will now be described more fully hereinafter with reference to the accompanying drawings. The exemplary embodiments may, however, be embodied in many different forms and should not be construed as limited to the embodiments set forth herein. In the drawings, the size and relative sizes of layers and regions may be exaggerated for clarity. Like numbers refer to like elements throughout.

It will be understood that when an element is referred to as being "connected" or "coupled" to another element, it can be directly connected or coupled to the other element or intervening elements may be present.

An adjusting circuit, which may adjust at least one of the delay and the pulse width of a synchronization signal according to various exemplary embodiments of the present inventive concepts, may be embodied inside a display controller, between the display controller and a display driver or inside the display driver.

BRIEF DESCRIPTION OF THE DRAWINGS

Embodiments of the present inventive concept will become more apparent by describing in detail exemplary embodiments thereof with reference to the attached drawings in which.

DETAILED DESCRIPTION OF EXEMPLARY EMBODIMENTS

Figure 1:
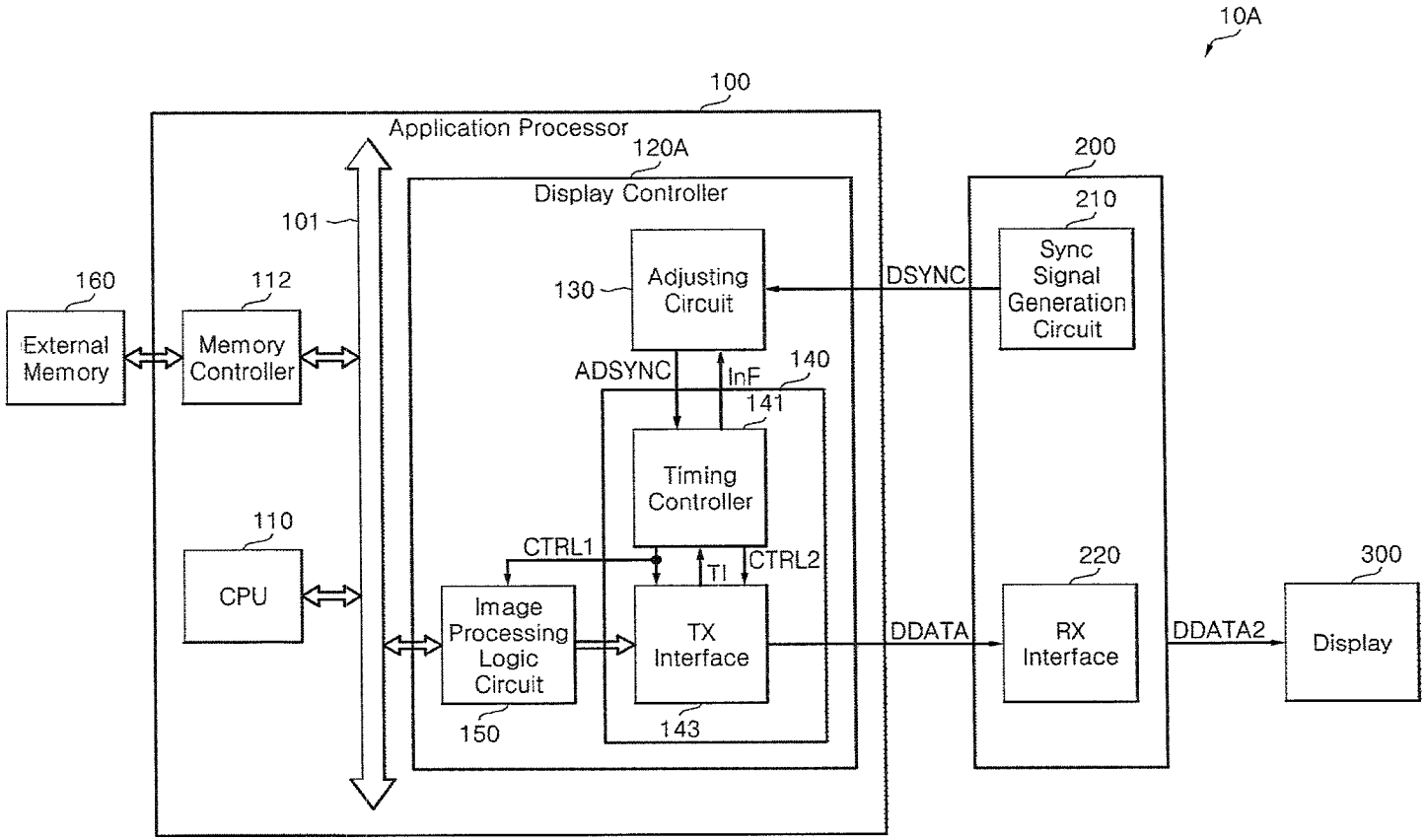
FIG. 1 is a block diagram of an image data processing system according to an exemplary embodiment of the present inventive concepts.

FIG. 1 is a block diagram of an image data processing system according to an exemplary embodiment of the present inventive concepts. Referring to FIG. 1, the image data processing system 10A includes an application processor 100, an external memory 160, a display driver 200 and a display 300. Each element 100, 160 and 200 may be embodied in separate chips.

According to an exemplary embodiment in which the application processor 100, and the display driver 200 are embodied in separate chips, the application processor 100 and the display driver 200 may be embodied in a module, a system on chip, or a package, e.g., a multi-chip package, system in package (SiP) or package on package (PoP). According to another exemplary embodiment in which the application processor 100, and the display driver 200 are embodied in separate chips, the display driver 200 and the display 300 may be embodied in a module.

The image data processing system 10A may be embodied in a personal computer (PC) or a portable device.

The portable device may be implemented as a laptop computer, a cellular phone, a smart phone, a tablet PC, a personal digital assistant (PDA), a portable multimedia player (PMP), a MP3 player, or a car automotive navigation system.

The application processor 100 controls an external memory 160 and/or the display driver 200. The application processor 100 receives a synchronization signal DSYNC output from a synchronization signal generation circuit 210 of the display driver 200 and related to transmission of display data DDATA, adjust at least one of the delay of the synchronization signal DSYNC and the pulse width of the synchronization signal DSYNC, to generate and output an adjusted synchronization signal ADSYNC. The application processor 100 also adjusts the transmission timing of the display data DDATA based on the adjusted synchronization signal AD SYNC.

Thus, to remove tearing and flickering, the application processor 100 adjusts at least one of the delay of the synchronization signal DSYNC and the pulse width of the synchronization signal DSYNC to generate and output an adjusted synchronization signal ADSYNC and adjusts the transmission timing of display data DDATA in response to the adjusted synchronization signal ADSYNC. Here, tearing or screen tearing means a visual artifact occurring when image data corresponding to two or more different frames are displayed on a screen in a display.

The application processor 100 includes a central processing unit (CPU) 110, a memory controller 112 and a display controller 120A which communicates with each other through an internal bus 101.

The CPU 110 of the application processor 100 generally controls the operations of the application processor 100.

Under the control of the CPU 110, the memory controller 112 transmits image data, e.g., moving image data or still image data, received from an external memory 160 to a display controller 120A through an internal bus 101. The external memory 160 may be implemented as a volatile memory device such as a dynamic random access memory (DRAM) or as a non-volatile memory such as a NAND flash memory.

Under the control of the CPU 110, the display controller 120A adjusts at least one of the delay and the pulse width of the synchronization signal DSYNC output from the display driver 200, and adjusts the transmission timing of display data, e.g., moving image data or still image data, in response to an adjusted synchronization signal ADSYNC.

In addition, the display controller 120A controls the transmission timing of at least one control signal related to transmission of display data DDATA. The display data DDATA may be embodied in data or in a data packet for suitable for a protocol of a data transmission (TX) interface 143.

The display controller 120A includes an adjusting circuit 130, a transmission timing control circuit 140 and an image processing logic circuit 150.

The adjusting circuit 130 receives and adjusts a synchronization signal DSYNC received from the display driver 200 and outputs an adjusted synchronization signal ADSYNC. For example, the synchronization signal DSYNC may be a control signal for removing tearing e.g., a tearing effect control signal.

For example, the CPU 110 may detect a mode change command and transmit a control signal corresponding to a detection result to the display driver 200 through the display controller 120A. Here, a synchronization signal generation circuit 210 of the display driver 200 generates a synchronization signal DSYNC in response to the control signal.

The mode change command may be generated from a peripheral device (not shown) by a gesture of an user, e.g., a touch, pressing a button, voice or a gesture. For example, the mode change command may be a command for changing from a first mode to a second mode. For example, the first mode may be a mode transmitting still image data to the display driver 200, and the second mode may be a mode transmitting moving image data to the display driver 200.

Moreover, the first mode may be a sleep mode and the second mode may be a normal mode. The sleep mode may be a mode where the application processor 100 and the display driver 200 do not process image data, and the normal mode may be a mode where the application processor 100 and the display driver 200 process the image data.

Figure 2:
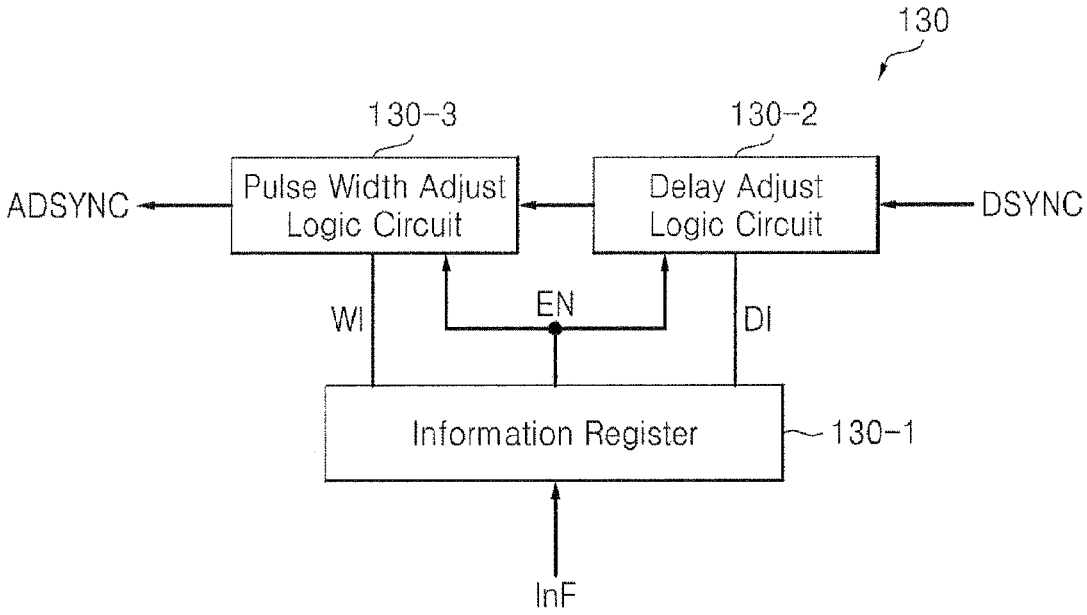
FIG. 2 is a block diagram of an adjusting circuit illustrated in FIG. 1.

FIG. 2 is a block diagram of the adjusting circuit illustrated in FIG. 1. The adjusting circuit 130 adjusts at least one of the delay and the pulse width of the received synchronization signal DSYNC. For example, the delay and the pulse width may be adjusted based on a control signal including difference information InF input to the adjusting circuit 130.

The adjusting circuit 130 includes an information register 130-1, a delay adjusting logic circuit 130-2, and a pulse width adjusting logic circuit 103-3. For example, an adjusting logic circuit includes the delay adjusting logic circuit 130-2 and the pulse width adjusting logic circuit 103-3. Information stored in the information register 130-1 may be set by the display controller 120A. The information stored in the information register 130-1 can be received and programmed from outside.

Figure 3:
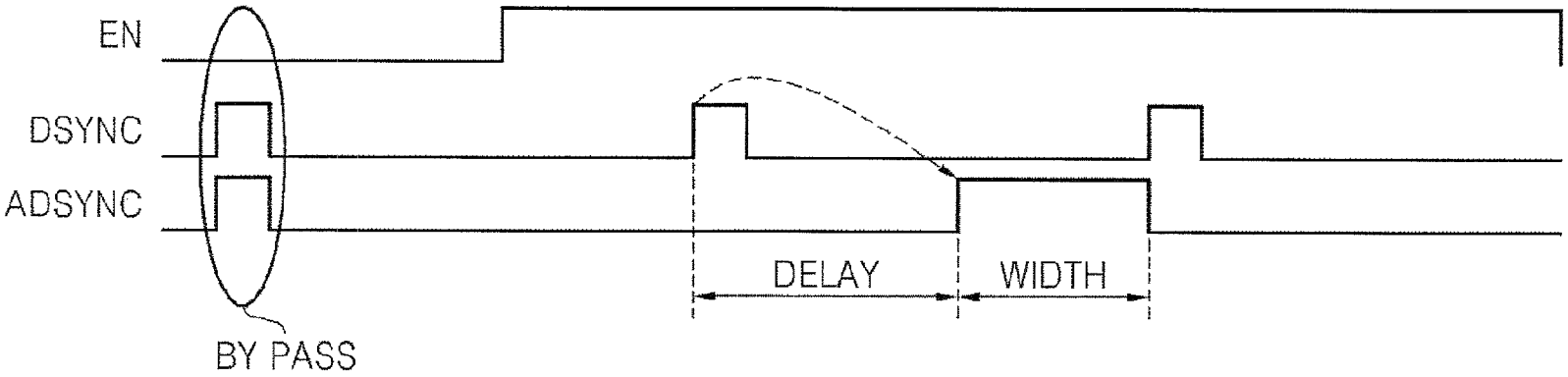
FIG. 3 is a timing diagram showing an exemplary operation of the adjusting circuit of FIG. 2.
Figure 4:
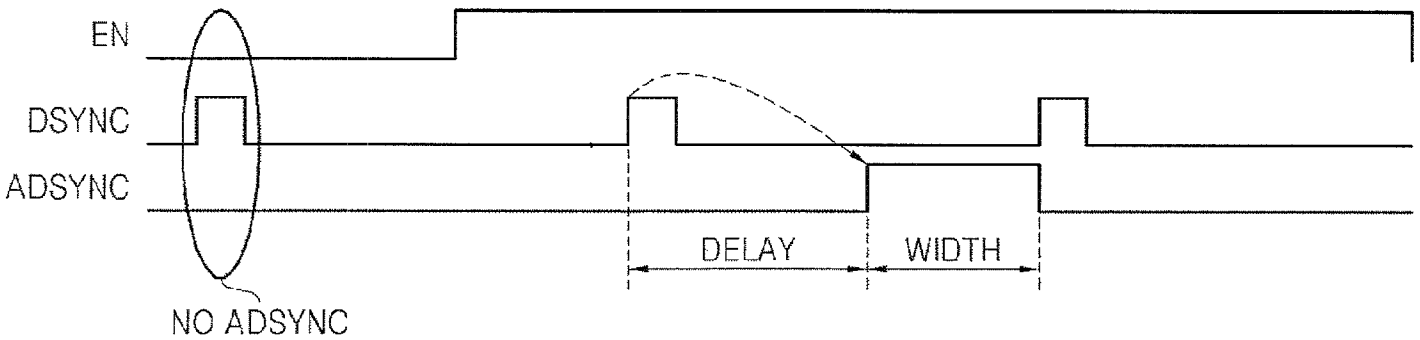
FIG. 4 is a timing diagram showing another exemplary operation of the adjusting circuit of FIG. 2.

FIG. 3 is a timing diagram showing an exemplary operation of the adjusting circuit of FIG. 2. FIG. 4 is another timing diagram showing another exemplary operation of the adjusting circuit of FIG. 2.

The delay adjusting logic circuit 130-2 and the pulse width adjusting logic circuit 130-3 may be enabled or disabled in response to an enable signal EN output from the information register 130-1. For example, when the enable signal EN is a first value, e.g., a logic 0 or a low level, the delay adjusting logic circuit 130-2 and the pulse width adjusting logic circuit 130-3 become disabled. When disabled, the delay adjusting logic circuit 130-2 and the pulse width adjusting logic circuit 130-3 may pass the synchronization signal DSYNC without adjustment as illustrated in FIG. 3 or may intercept (or block) the synchronization signal DSYNC as illustrated in FIG. 4.

However, when the enable signal EN is a second value, e.g., a logic 1 or a high level, the delay adjusting logic circuit 130-2 and the pulse width adjusting logic circuit 130-3 become enabled. Accordingly, the delay adjusting logic circuit 130-2 adjusts the delay DELAY of the synchronization signal DSYNC based on delay adjusting information DI output from the information register 130-1 and outputs the delay adjusted synchronization signal. Here, the delay adjusting information DI includes one-bit or more bits.

The pulse width adjusting logic circuit 130-3 adjusts the pulse width WIDTH of a signal output from the delay adjusting logic circuit 130-2 based on pulse width adjusting information WI output from the information register 130-1, and outputs a finally adjusted synchronization signal ADSYNC. Here, the pulse width adjusting information WI includes one-bit or more bits.

In FIGS. 2, 3, 4, 6 and 7, the information register 130-1 stores information, e.g., difference information InF, for adjusting at least one of the delay DELAY of the synchronization signal DSYNC and the pulse width WIDTH of the synchronization signal DSYNC. As described above, the information, e.g., difference information InF, includes delay adjusting information DI which may adjust the delay of the synchronization signal DSYNC and pulse width adjusting information WI which may adjust the pulse width of the synchronization signal DSYNC.

For convenience of explanation, the information register 130-1 storing difference information InF is illustrated in FIG. 2; however, when the adjusting circuit 130 does not include the information register 130-1 according to an alternative embodiment, the delay adjusting logic circuit 130-2 adjusts the delay DELAY of a synchronization signal DSYNC directly according to delay adjusting information DI included in the difference information InF output from the timing controller 141. Moreover, the pulse width adjusting logic circuit 103-3 may adjust the pulse width WIDTH of the synchronization signal directly according to pulse width adjusting information WI included in the difference information InF output from the timing controller 141.

The adjusting circuit 130 transmits an adjusted synchronization signal ADSYNC to the timing controller 141.

The transmission timing control circuit 140 controls the transmission timing of display data DDATA which will be transmitted to the display driver 200 in response to the adjusted synchronization signal ADSYNC output from the adjusting circuit 130.

The transmission timing control circuit 140 includes a timing controller 141 and a transmission TX interface 143. The timing controller 141 generates a first control signal CTRL1 in response to one of a rising edge and a falling edge (e.g., a rising edge) of an adjusted synchronization signal ADSYNC, and generates a second control signal CTRL2 in response to the other of the rising edge and the falling edge, (e.g., a falling edge).

Figure 5:
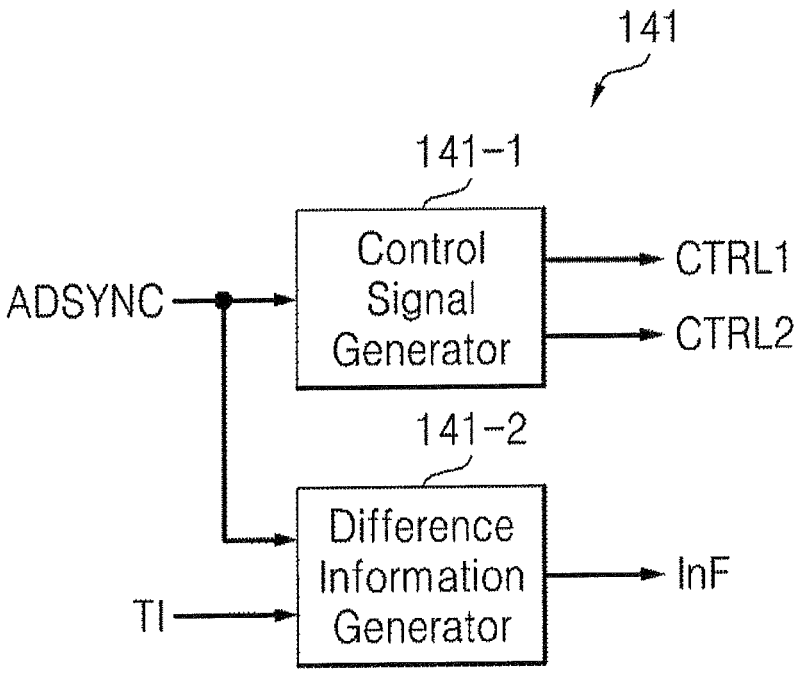
FIG. 5 is a block diagram of the timing controller shown in FIG. 1.

FIG. 5 is a block diagram of the timing controller 141 in the image data processing system 10A of FIG. 1. A control signal generator 141-1 of the timing controller 141 generates a first control signal CTRL1 and a second control signal CTRL2.

An image processing logic circuit 150 and the transmission TX interface 143 prepare transmission of the display data DDATA in response to a level transition of the first control signal CTRL1.

According to the second control signal CTRL2, the transmission interface 143 transmits display data DDATA output from the image processing logic circuit 150 to a receiving RX interface 220 of the display driver 200. According to an exemplary embodiment, the transmission TX interface 143 embodied in a low power interface may be embodied in a CPU interface, a RGB interface or a serial interface. According to another exemplary embodiment, the transmission TX interface 143 may be embodied in a mobile display digital interface (MDDI), a mobile industry processor interface (MIPI®), a serial peripheral interface (SPI), an inter IC ($I^2C$) interface, a display port (DP) or an embedded display port (eDP).

The receiving RX interface 220 may be embodied in an interface the same as the transmission TX interface 143. The transmission TX interface 143 transmits information TI for the transmission timing of display data DDATA to the timing controller 141.

A difference information generator 141-2 of the timing controller 141 generates difference information InF by using information for the timing of an adjusted synchronization signal ADSYNC and information TI for the transmission timing of display data DDATA, and writes or stores generated difference information InF in the information register 130-1 of the adjusting circuit 130. As described above, the difference information InF may be input directly to the adjusting logic circuit 130.

The difference information InF may include delay adjusting information DI and/or pulse width adjusting information WI as information corresponding to the difference between a timing of an adjusted synchronization signal ADSYNC and the transmission timing of the display data DDATA. Accordingly, the adjusting circuit 130 may adjust at least one of the delay and the pulse width of the synchronization signal DSYNC.

The display driver 200 receives and processes display data DDATA transmitted from the display controller 120A, and transmits processed display data DDATA2 to a display 300. The display driver 200 includes a synchronization signal generation circuit 210 which may generate the synchronization signal DSYNC. The detailed structure and operation of an exemplary implementation of the display driver 200 will be explained in detail referring to FIG. 9.

The display 300 may be implemented as a liquid crystal display (LCD), a light emitting diode (LED) display, an organic LED (OLED) display, or an active-matrix OLED (AMOLED) display, or another type of display.

Figure 6:
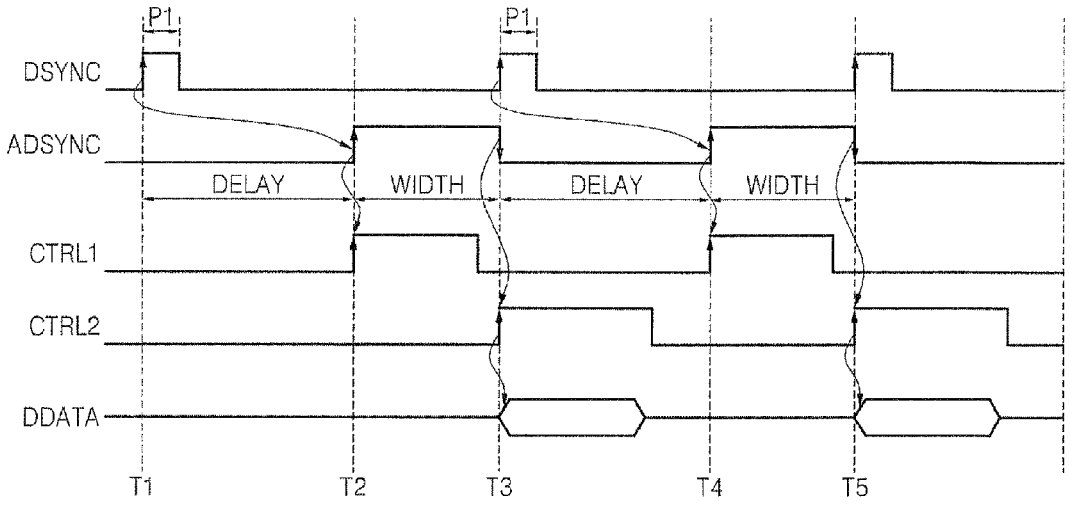
FIG. 6 is a timing diagram showing an exemplary operation of the adjusting circuit and a transmission timing control circuit illustrated in FIG. 1.

FIG. 6 is a timing diagram showing an exemplary operation of the adjusting circuit 130 and the transmission timing control circuit 140 illustrated in FIG. 1. And FIG. 7 is another timing diagram showing other exemplary operations of the adjusting circuit and the transmission timing control circuit illustrated in FIG. 1.

Referring to FIGS. 1 to 7, the adjusting circuit 130 receives a synchronization signal DSYNC having a pulse width P1 at a first time point T1, adjusts at least one of the delay DELAY and the pulse width WIDTH of the synchronization signal DSYNC according to information or difference information InF stored in the information register 130-1, and generates an adjusted synchronization signal ADSYNC.

The control signal generator 141-1 of the timing controller 141 detects level transitions of the adjusted synchronization signal ADSYNC and generates a first control signal CTRL1 and a second control signal CTRL2 based on a detection results.

Figure 7:
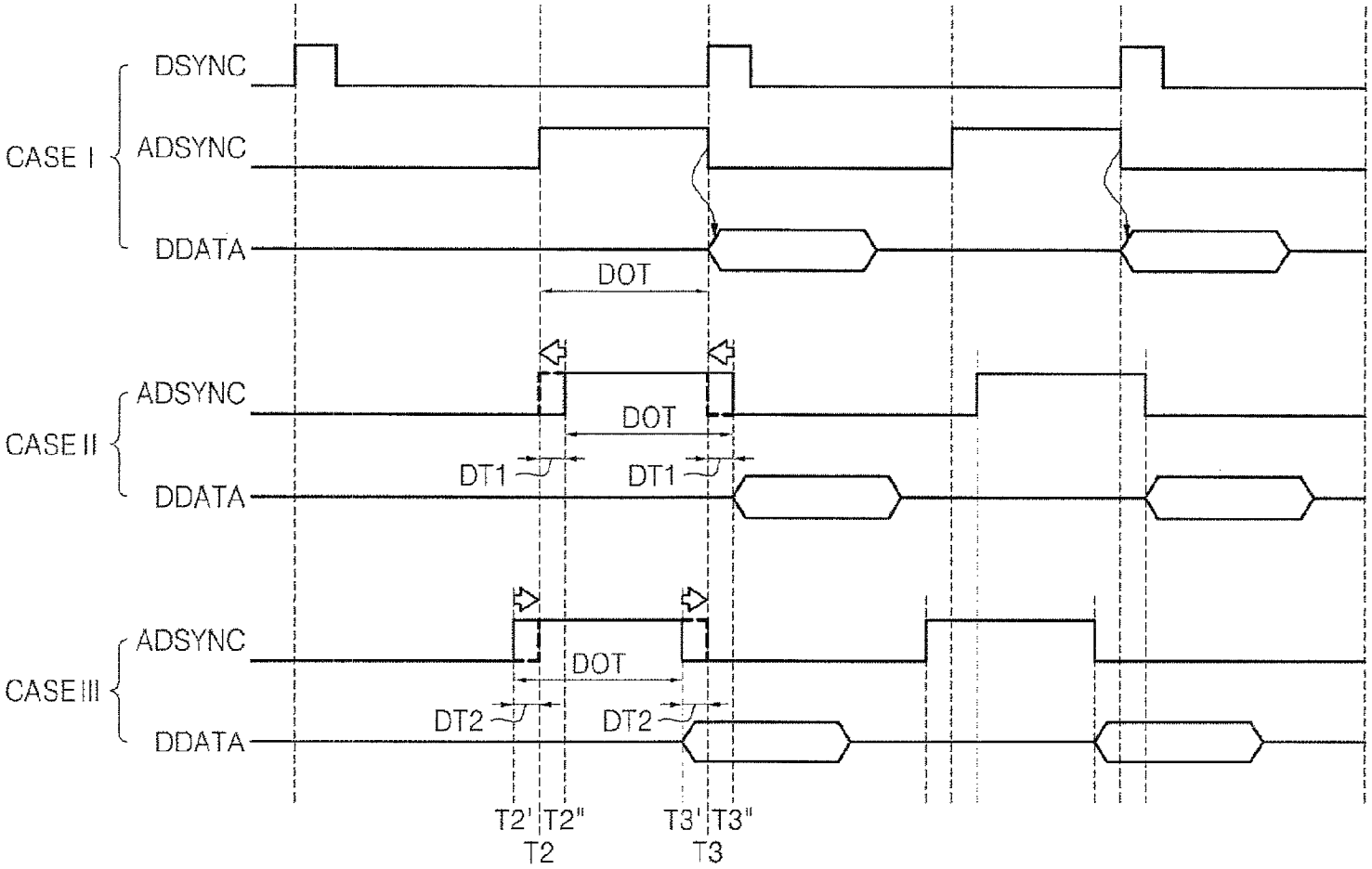
FIG. 7 is a timing diagram showing other exemplary operations of the adjusting circuit and the transmission timing control circuit illustrated in FIG. 1.

As illustrated in FIGS. 6 and 7, the control signal generator 141-1 generates a first control signal CTRL in response to a rising edge of the adjusted synchronization signal ADSYNC at a second time point T2. Here, the image processing logic circuit 150 and the transmission interface 143 prepare transmission of display data DATA based on an activated first control signal CTRL1. Afterwards, the transmission interface 143 transmits display data DATA to the display driver 200 based on an activated second control signal CTRL2 at a third time point T3. Thus, the transmission interface 143 transmits the display data DATA to the display driver 200 in response to a falling edge of the adjusted synchronization signal ADSYNC at a third time point T3.

As illustrated in case I of FIG. 7, once a display data output time DOT passes after an adjusted synchronization signal ADSYNC transits from a low level to a high level at a second time point T2, i.e., when display data DATA, e.g., moving image data, are output from the display controller 120A to the display driver 200 at a third time point T3, it is assumed that tearing and flickering do not occur in the display 300.

In addition, the display data output time DOT is assumed to be a fixed time. Thus, when display data DDATA output from the display controller 120A are converted from still image data into moving image data, it is highly possible that a flicker has occurred.

Referring to case II of FIG. 7, since display data DDATA, e.g., moving image data, are output from a time point T3", tearing and flickering may occur in the display 300. Accordingly, in order to remove tearing and flickering, the display controller 120A should adjust an output time point of the display data DDATA from T3" to T3.

The adjusting circuit 130 adjusts a generation time point of an adjusted synchronization signal ADSYNC from T2" to T2 by using information or difference information InF stored in the information register 130-1. For example, when the adjusting circuit 130 adjusts the delay DT1 or DELAY of FIG. 6 of a synchronization signal DSYNC, the transmission timing control circuit 140 can output display data DDATA exactly at a time point T3 based on the delay-adjusted synchronization signal ADSYNC.

Referring to case III of FIG. 7, since display data DDATA, e.g., moving image data, are output from a time point T3', tearing and flicking may occur in the display 300. Accordingly, to remove tearing and flickering, the display controller 120A should adjust an output time point of the display data DDATA from T3' to T3.

By using information or difference information InF stored in the information register 130-1, the adjusting circuit 130 can adjust the generation time point of an adjusted synchronization signal ADSYNC from T2' to T2. For example, when the adjusting circuit 130 adjusts the delay DT2 or DELAY of FIG. 6 of a synchronization signal DSYNC, the transmission timing control circuit 140 can output display data DDATA exactly at the time point T3 based on the delay-adjusted synchronization signal ADSYNC.

Difference information InF can be updated at every frame. Accordingly, the display controller 120A can adjust the transmission timing of display data DDATA corresponding to a current frame by using difference information InF on a previous frame.

Figure 8:
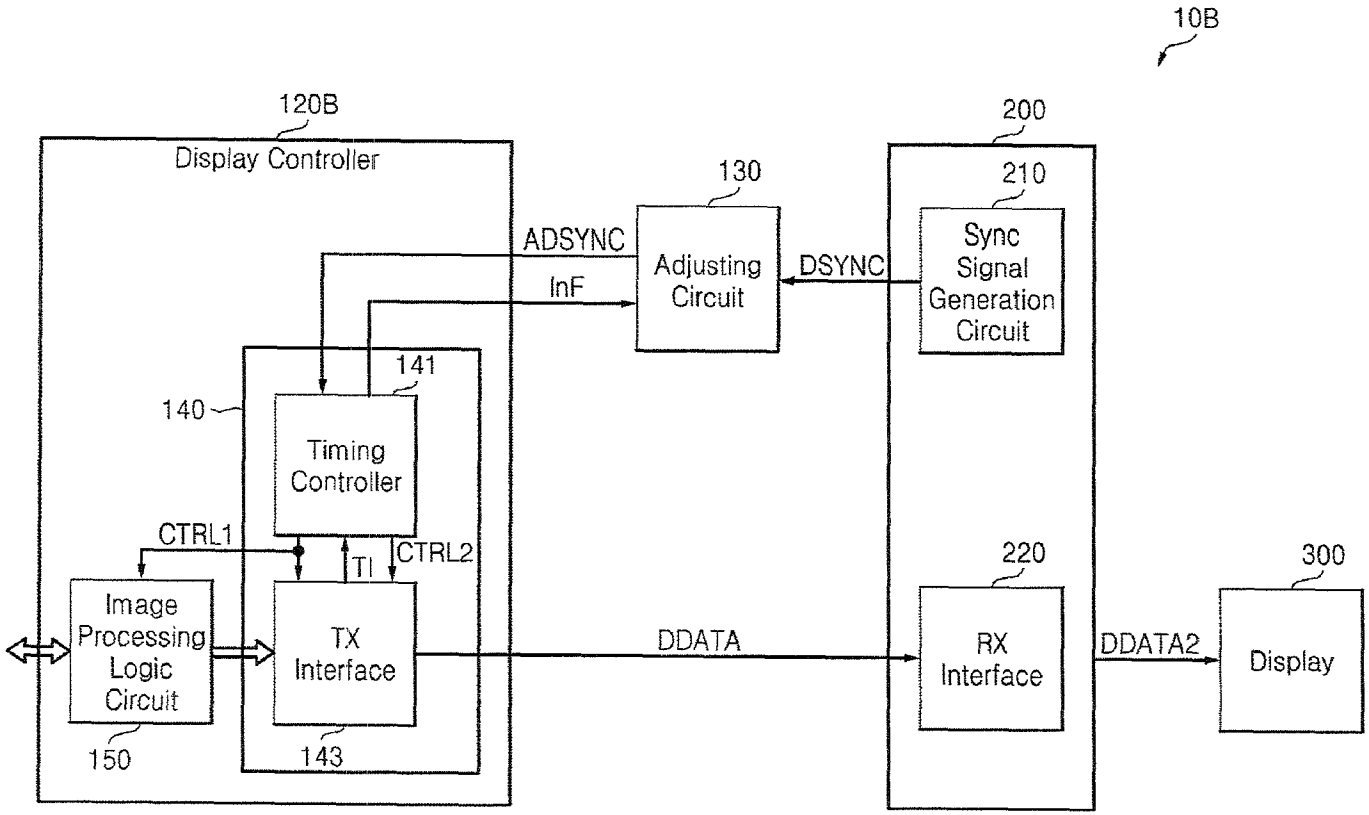
FIG. 8 is a block diagram of an image data processing system according to another exemplary embodiment of the present inventive concepts.

FIG. 8 is a block diagram of the image data processing system according to another exemplary embodiment of the present inventive concept. Referring to FIGS. 1 and 8, the structure of the image data processing system 10A of FIG. 1 is substantially the same as a structure of an image data processing system 10B of FIG. 8, except that the adjusting circuit 130 exists between the display controller 120B and the display driver 200. For convenience of explanation, FIG. 8 does not redundantly illustrate each other element 101, 110, 112 and 160.

The transmission timing control circuit 140 of the display controller 120B controls the transmission timing of display data DDATA transmitted to the display driver 200 based on a synchronization signal ADSYNC whose delay DELAY and/or pulse width WIDTH is adjusted by the control circuit 130.

Figure 9:
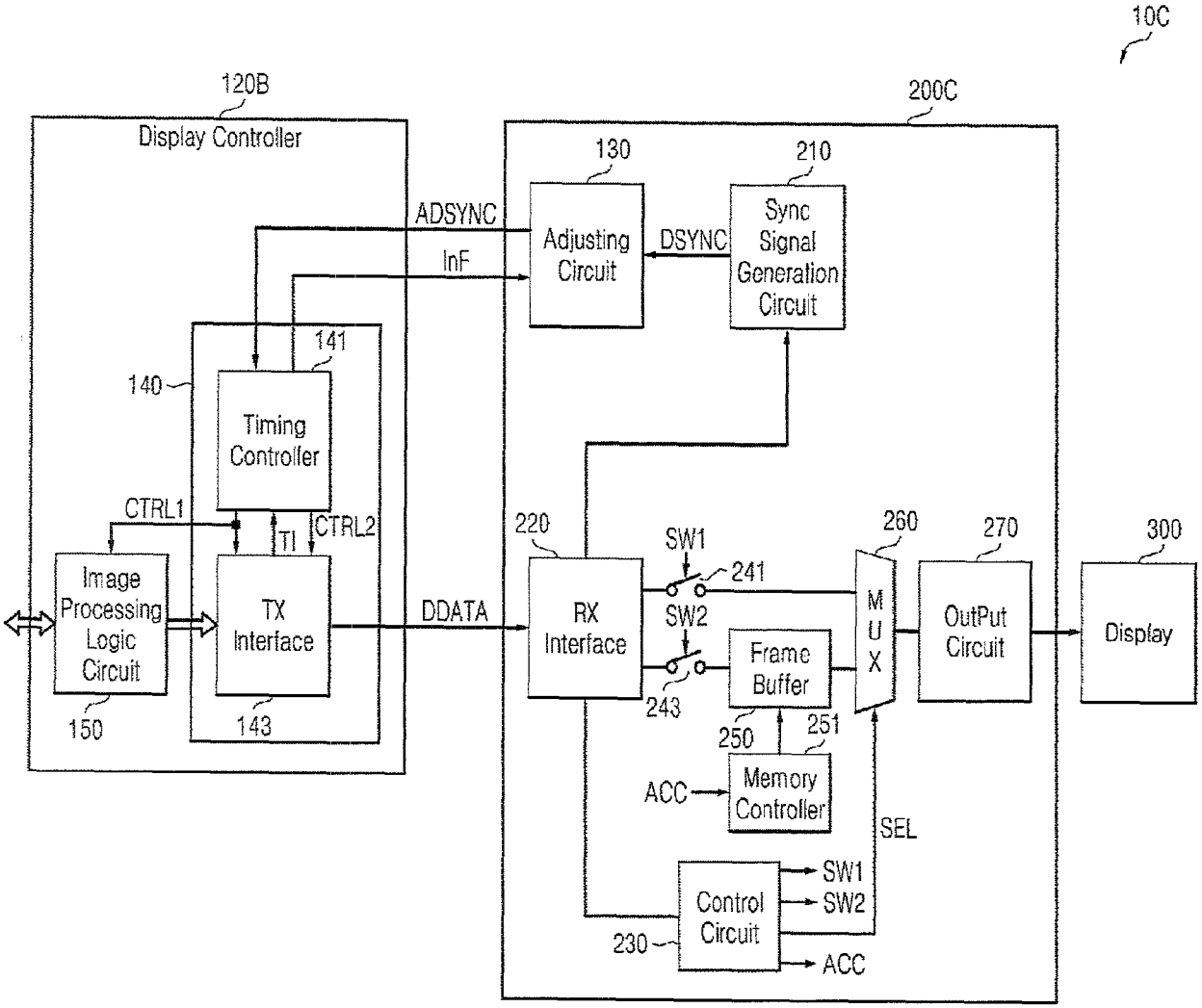
FIG. 9 is a block diagram of the image data processing system according to still another exemplary embodiment of the present inventive concepts.

FIG. 9 is a block diagram of the image data processing system according to still another exemplary embodiment of the present inventive concept. Except that the adjusting circuit 130 is inside of a display driver 200C, the structure of the image data processing system 10A of FIG. 1 is substantially the same as a structure of an image data processing system 10C of FIG. 9.

The display driver 200C includes the adjusting circuit 130, the synchronization signal generation circuit 210, a receiving RX interface 220, a control circuit 230, a plurality of switches 241 and 143, a frame buffer 250, a memory controller 251, a selection circuit 260 and an output circuit 270.

The synchronization signal generation circuit 210 generates a synchronization signal DSYNC based on data input through the receiving interface 220 or a control signal output from the control circuit 230.

The control circuit 230 generates a plurality of switch control signals SW1 and SW2, an access control signal ACC and a selection signal SEL according to display data DDATA input through the receiving interface 220.

A first switch 241 transmits display data DDATA, e.g., moving image data, to the selection circuit 260 in response to a first switch control signal SW1. The first switch 241 performs the function of a control circuit controlling transmission of moving image (video) data. A second switch 243 transmits display data DDATA, e.g., still image data, to the frame buffer 250 in response to a second switch control signal SW2. The second switch 243 performs the function of a control circuit controlling transmission of still image (Photograph) data.

Thus, moving image (video) data or display data having a first frame rate are transmitted to the output circuit 270 through the selection circuit 260, not through the frame buffer 250. Still image data or display data having a second frame rate are transmitted to the output circuit 270 through the frame buffer 250 and the selection circuit 260. Thus, moving image (video) data and still image (photograph) data are transmitted to the output circuit 270 through different data paths, respectively.

The first frame rate is greater than the second frame rate. For example, the first frame rate and the second frame rate may be classified on a basis of a certain frame rate, e.g., 30 frames per second (fps).

The memory controller 251 controls a data access operation for the frame buffer 250, e.g., a data write operation or a data read operation, based on an access control signal ACC. The frame buffer 250 may be embodied in a graphic memory.

The selection circuit (MUX) 260 transmits display data, e.g., video data transmitted through a first path, (i.e., a first switch 241), or still image data output from a second path, (i.e., the frame buffer 250), to the output circuit 270 based on a selection signal SEL. The selection circuit 260 may be implemented as a multiplexer.

The output circuit 270 processes display data output from the selection circuit 260 and transmits processed display data DDATA2 to the display 300.

Figure 10:
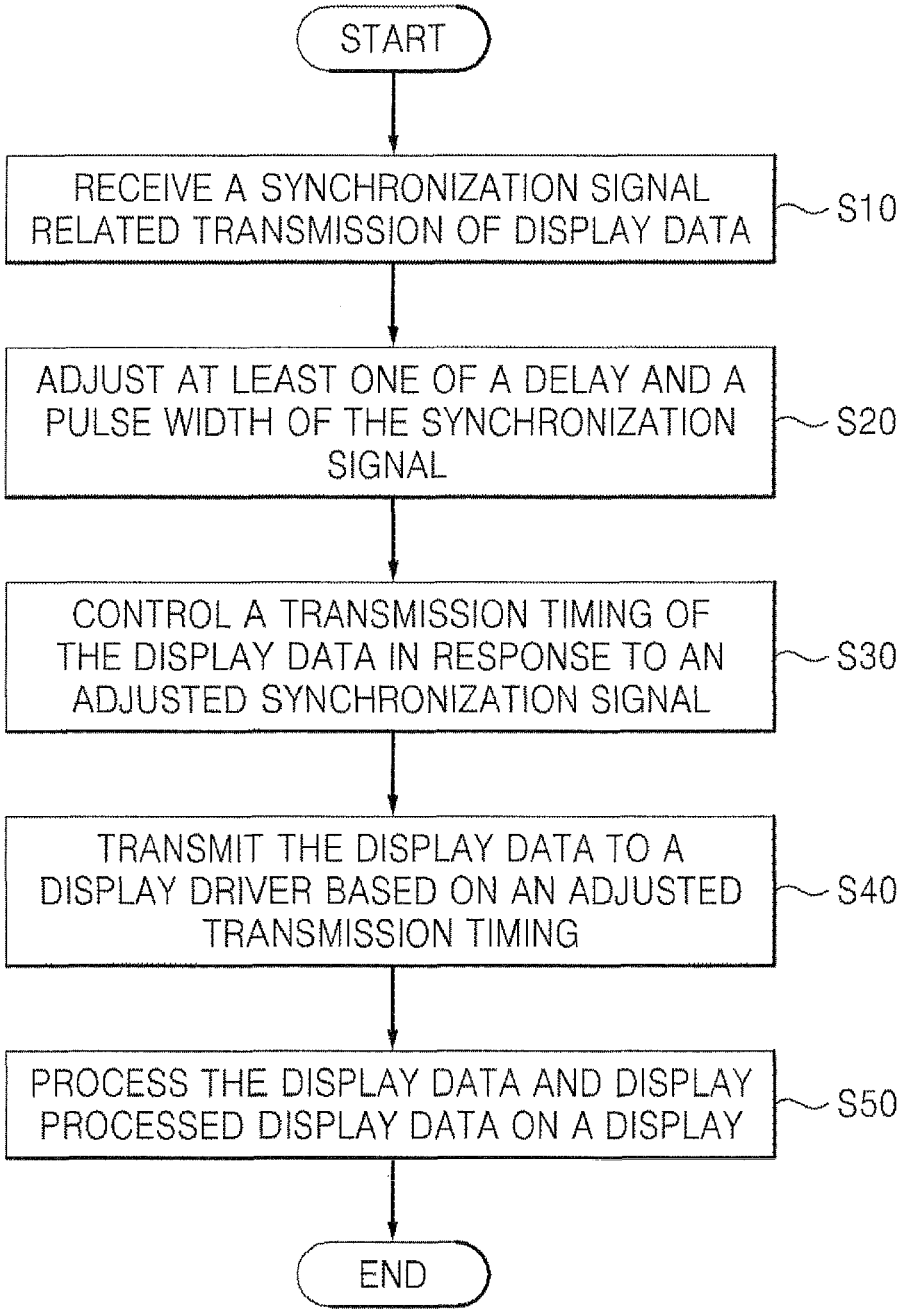
FIG. 10 is a flowchart for explaining a method of operation of the image data processing system illustrated in FIG. 1, 8 or 9.

FIG. 10 is a flowchart for explaining a method of operation of the image data processing systems shown in FIG. 1, 8 or 9. Referring to FIGS. 1 to 10, the adjusting circuit 130 receives a synchronization signal DSYNC related to transmission of display data DDATA (S 10).

As illustrated in FIG. 6 or 7, the adjusting circuit 130 adjusts at least one of the delay DELAY and the pulse width WIDTH of a synchronization signal DSYNC, and outputs a synchronization signal ADSYNC whose delay DELAY and/or pulse width WIDTH is adjusted (in step S20). According to an exemplary embodiment, the adjusting circuit 130 can adjust at least one of the delay DELAY and the pulse width WIDTH by using information or difference information InF stored in the information register 130-1.

As illustrated in FIG. 6 or 7, the transmission timing control circuit 140 can control the transmission timing of display data DDATA in response to an adjusted synchronization signal ADSYNC (in step S30). The transmission timing control circuit 140 transmits display data DDATA to the display driver 200 based on an adjusted transmission timing (in step S40). The display driver 200 processes the display data DDATA, transmits processed display data DDATA2 to the display 300, and the display 300 displays the processed display data DDATA2 (in step S50).

Figure 11:
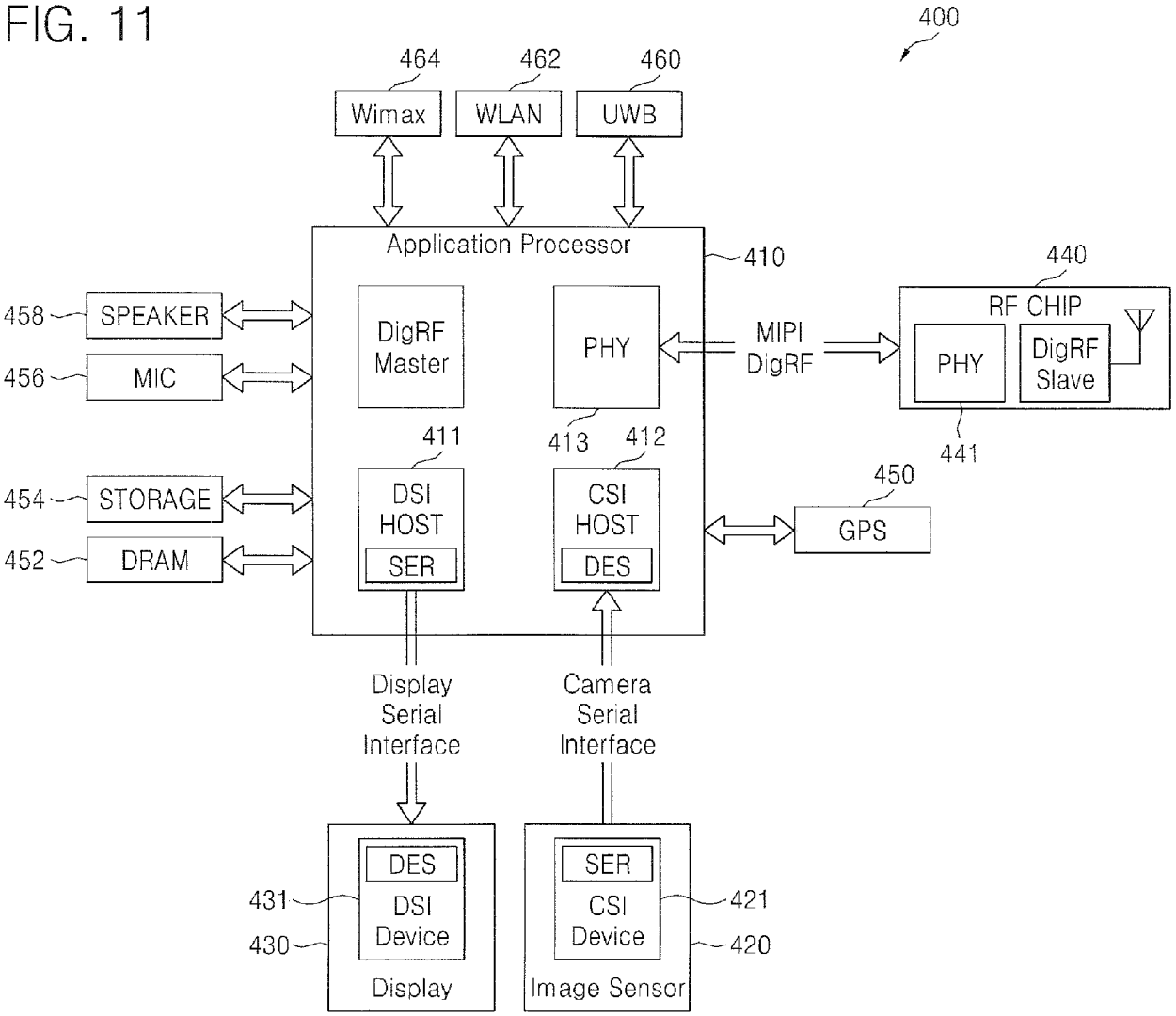
FIG. 11 is a block diagram of the image data processing system including a display controller according to an exemplary embodiment of the present inventive concepts.

FIG. 11 is a block diagram of an image data processing system including a display controller according to an exemplary embodiment of the present inventive concept. Referring to FIG. 11, the image data processing system 400 can be embodied in a portable device such as a personal digital assistant (PDA), a portable media player (PMP), a cellular phone, a smart phone or a tablet personal computer, which may use or support MIPI®.

The image data processing system 400 includes an application processor 410, an image sensor 420 and a display 430.

A camera serial interface (CSI) host 412 embodied in the application processor 410 can perform a serial communication with a CSI device 421 of the image sensor 420 through a camera serial interface CSI. According to an exemplary embodiment, a de-serializer (DES) can be embodied in the CSI host 412 and a serializer (SER) can be embodied in the CSI device 421. A display serial interface (DSI) host 411 embodied in the application processor 410 can perform a serial communication with a DSI device 431 of the display 430 through a display serial interface. According to an exemplary embodiment, a serializer (SER) can be embodied in the DSI host 411 and a de-serializer (DES) can be embodied in the DSI device 431.

The image data processing system 400 may further include a RF chip 440 which can communicate with the application processor 410. A PHY 413 of the image data processing system 400 and a PHY 441 of a RF chip 440 can transmit or receive data according to MIPI DigRF protocol.

The image data processing system 400 may include a GPS 450 receiver, a memory 452 such as a dynamic random access memory (DRAM), a data storage device 454 embodied in a non-volatile memory like a NAND flash memory, a microphone 456 or a speaker 458.

In addition, the image data processing system 400 may communicate with an external device by using at least one communication protocol or communication standard, e.g., a ultra-wideband (UWB) 460, a Wireless LAN (WLAN) 462, a worldwide interoperability for microwave access (WiMAX) 464 or a long term evolution (LTE™).

According to an alternative embodiment, the DSI host 411 may perform the function of the display controller 120A of FIG. 1. According to another alternative embodiment, the adjusting circuit 130 may be embodied outside of the DSI host 411. According to still another alternative embodiment, the adjusting circuit 130 may be embodied inside of the DSI device 431 which can perform the function of the display driver 200.

Figure 12:
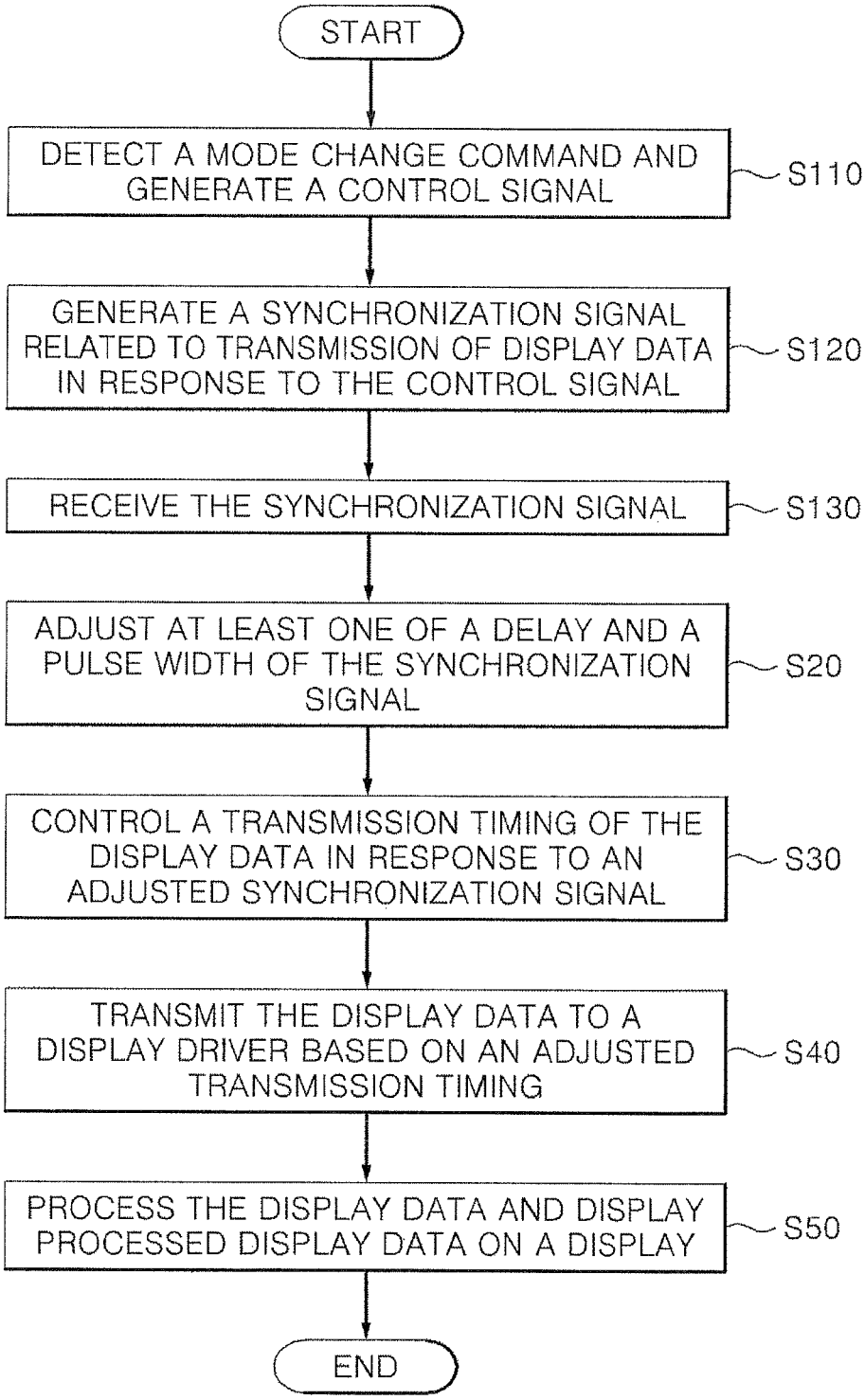
FIG. 12 is a flowchart for explaining a method of operation of the image data processing system of FIG. 12 which may detect a mode change command according to an exemplary embodiment of the present inventive concepts.

FIG. 12 is a flowchart for explaining a method of operation of an image data processing system which detects a mode change command according to an exemplary embodiment of the present inventive concepts. Referring to FIGS. 1 to 12, a CPU 110 detects a mode change command and transmits a control signal corresponding to a detection result to the display driver 200 (in step S 110). The display driver 200 generates a synchronization signal DSYNC in response to the control signal (in step S120). The synchronization signal DSYNC is a signal related to transmission of display data DDATA. The adjusting circuit 130 receives the synchronization signal DSYNC (in step S130).

Each of steps S20 to S50 of FIG. 12 is the same as each corresponding step S20 to S50 of FIG. 10. A device according to an exemplary embodiment of the present inventive concepts and a method thereof can adjust at least one of the delay and the pulse width of a synchronization signal and output an adjusted synchronization signal, so that a display controller can output moving image (video) data to a display driver with exact timing based on to the adjusted synchronization signal.

Accordingly, the device and the method can prevent or remove tearing and flicker which may occur when display data are converted from still image data into moving image (video) data.

Although a exemplary embodiments of the present general inventive concept have been shown and described, it will be appreciated by those skilled in the art that changes can be made in these embodiments without departing from the principles and spirit of the general inventive concept, the scope of which is defined in the appended claims and their equivalents.

What is claimed is:

1. A display controller comprising:

an adjusting circuit configured to receive a synchronization signal output from a display driver, configured to adjust, based on information for adjusting the synchronization signal, at least one of a delay or a pulse width of the synchronization signal, and configured to output the adjusted synchronization signal; and a transmission timing control circuit configured to control the transmission timing of display data in response to the adjusted synchronization signal and configured to transmit transmission timing-adjusted display data to the display driver.

2. The display controller of claim 1, wherein the synchronization signal is a signal related to transmission of the display data.

3. The display controller of claim 1, wherein the adjusting circuit includes:

an information register configured to store the information for adjusting the synchronization signal; and an adjusting logic circuit configured to adjust the at least one of the delay and the pulse width of the synchronization signal by using the information.

4. The display controller of claim 1, wherein the transmission timing control circuit transmits the display data to the display driver in response to one of a rising edge and a falling edge of the adjusted synchronization signal.

5. The display controller of claim 1, further comprising:

a transmission interface configured to prepare transmission of the display data in response to a first edge of the adjusted synchronization signal and transmit the display data to the display driver in response to a second edge of the adjusted synchronization signal, wherein the first edge is a rising edge and the second edge is a falling edge, or the first edge is a falling edge and the second edge is a rising edge.

6. The display controller of claim 5, wherein the transmission interface is a CPU interface, a RGB interface or a serial interface.

7. The display controller of claim 5, wherein the transmission interface is a mobile display digital interface (MDDI), a mobile industry processor interface (MIPI), a serial peripheral interface (SPI), an inter IC ($I^2C$) interface, a display port (DP) or an embedded display port (eDP).

8. The display controller of claim 1, further comprising:

a timing controller configured to generate a first control signal in response to a first edge of the adjusted synchronization signal and generate a second control signal in response to a second edge of the adjusted synchronization signal, wherein the first edge is a rising edge and the second edge is a falling edge, or the first edge is a falling edge and the second edge is a rising edge; and a transmission interface configured to prepare transmission of the display data in response to the first control signal and transmit the display data to the display driver in response to the second control signal.

9. The display controller of claim 1, wherein the display controller and the display driver are embodied in separated chips.

10. The display controller of claim 1, wherein the synchronization signal is a control signal for removing tearing.

11. A display controller comprising:

an adjusting circuit configured to adjust, based on information for adjusting a synchronization signal, at least one of the delay and the pulse width of the synchronization signal generated in a display driver, and configured to output the adjusted synchronization signal; and a transmission timing control circuit configured to control the transmission timing of display data to be transmitted to the display driver, in response to the adjusted synchronization signal, wherein the transmission timing control circuit generates difference information corresponding to difference between a level transition timing of the adjusted synchronization signal and the controlled transmission timing, and wherein the adjusting circuit adjusts the synchronization signal by using the difference information as the information for adjusting the synchronization signal.

12. The display controller of claim 11, wherein the adjusting circuit includes:

a register configured to store the difference information; and a delay adjusting circuit configured to adjust the delay of the synchronization signal by using the difference information as the information for adjusting the synchronization signal; and a pulse width adjusting circuit configured to adjust the pulse width of the delay-adjusted synchronization signal output from the delay adjusting circuit by using the difference information as the information for adjusting the synchronization signal and to generate the adjusted synchronization signal.

13. A method for processing display data of a portable device comprising:

receiving a synchronization signal output from a display driver and which is related to transmission of display data;

adjusting, based on information for adjusting the synchronization signal, at least one of a delay or a pulse width of the synchronization signal and generating an adjusted synchronization signal;

adjusting the transmission timing of the display data in response to the adjusted synchronization signal and transmitting the transmission timing-adjusted display data to the display driver; and processing the timing-adjusted display data and displaying processed display data on a display.

14. The method of claim 13, wherein the information for adjusting the synchronization signal is output from a display controller, and wherein the generating the adjusted synchronization signal adjusts at least one of the delay and the pulse width by using the information output from the display controller, to adjust the transmission timing, and to generate the adjusted synchronization signal.

15. The method of claim 14, wherein the information for adjusting the synchronization signal is determined based on the difference between a level transition timing of the adjusted synchronization signal and the controlled transmission timing.

16. The method of claim 13, wherein the portable device is one of a cellular phone, a smart phone and a tablet personal computer.

17. A method for processing display data of a portable device comprising:

detecting a mode change command in a CPU and transmitting a control signal corresponding to the detection result to a display driver;

receiving a synchronization signal output from the display driver; and related to transmission of display data;

adjusting, based on information for adjusting the synchronization signal, at least one of a delay or a pulse width of the synchronization signal and generating the adjusted synchronization signal;

adjusting the transmission timing of the display data in response to the adjusted synchronization signal and transmitting the transmission timing-controlled display data to the display driver; and processing the transmission timing-controlled display data and displaying processed display data on a display, wherein the synchronization signal is generated based on the control signal.

18. The method of claim 17, wherein generating the adjusted synchronization signal adjusts at least one of the delay and the pulse width by using information for adjusting the synchronization signal output from a display controller, to adjust the transmission timing, and to generate the adjusted synchronization signal.

19. A display controller comprising:

an adjusting circuit configured to receive a synchronization signal output from a display driver, wherein the synchronization signal is a signal related to the transmission of display data being transmitted from the display driver to a display, wherein the adjusting circuit is further configured to adjust, based on information for adjusting a synchronization signal, at least one of a delay or a pulse width of the synchronization signal generated in the display driver and configured to output the adjusted synchronization signal.

20. The display controller of claim 19, further comprising:

a transmission timing control circuit configured to provide the information based on the controlled transmission timing of display data for adjusting the synchronization signal, and to control the transmission timing of the display data, which will be transmitted from the display controller to the display driver, in response to the adjusted synchronization signal.

21. The display controller of claim 20, wherein the transmission timing control circuit generates difference information corresponding to difference between a level transition timing of the adjusted synchronization signal and the transmission timing.

22. The display controller of claim 21, wherein the adjusting circuit adjusts the synchronization signal by using the difference information as the information for adjusting the synchronization signal.

23. The display controller of claim 19 wherein the display driver comprises a driver circuit for processing display data, driving the display with the processed display data, and providing a synchronization signal, and the adjusting circuit is configured to receive the synchronization signal from the driver circuit, receive information for adjusting the synchronization signal, and adjust at least one of a delay or a pulse width of the synchronization signal based on the received information, the display controller further comprising:

a transmission timing control circuit configured to receive the adjusted synchronization signal from the adjusting circuit, control the transmission timing of the display data to the driver circuit based on the adjusted synchronization signal, and output to the adjusting circuit the information for adjusting the synchronization signal, wherein the information for adjusting the synchronization signal is responsive to at least one difference between the adjusted synchronization signal and the controlled transmission timing of display data.

* * * * *